US008402739B2

(12) United States Patent
Jain et al.

(10) Patent No.: US 8,402,739 B2
(45) Date of Patent: Mar. 26, 2013

(54) VARIABLE SHAPE INLET SECTION FOR A NACELLE ASSEMBLY OF A GAS TURBINE ENGINE

(75) Inventors: Ashok K. Jain, Tempe, AZ (US); Zaffir A. Chaudhry, South Glastonbury, CT (US)

(73) Assignee: United Technologies Corporation, Hartford, CT (US)

( * ) Notice: Subject to any disclaimer, the term of this patent is extended or adjusted under 35 U.S.C. 154(b) by 1473 days.

(21) Appl. No.: 11/769,749

(22) Filed: Jun. 28, 2007

(65) Prior Publication Data

US 2009/0003997 A1 Jan. 1, 2009

(51) Int. Cl.
*F02K 3/02* (2006.01)

(52) U.S. Cl. ..... 60/226.1; 60/262; 137/15.1; 137/15.2; 244/53 B

(58) Field of Classification Search ..... 60/226.1, 60/262, 269; 137/15.1, 15.2; 244/53 R, 244/53 B; 415/156
See application file for complete search history.

(56) References Cited

U.S. PATENT DOCUMENTS

| | | | | |
|---|---|---|---|---|
| 2,915,262 | A | 12/1959 | Klein | |
| 2,948,111 | A * | 8/1960 | Nelson | 60/269 |
| 3,059,878 | A | 10/1962 | Kerry et al. | |
| 3,074,232 | A | 1/1963 | Soyer | |
| 3,119,581 | A | 1/1964 | Trevaskis | |
| 3,222,863 | A | 12/1965 | Klees et al. | |
| 3,298,637 | A | 1/1967 | Lee | |
| 3,422,624 | A | 1/1969 | Brooks et al. | |
| 3,524,611 | A | 8/1970 | Frank | |
| 3,532,100 | A | 10/1970 | Hilton | |
| 3,541,794 | A | 11/1970 | Johnston et al. | |
| 3,568,694 | A | 3/1971 | Johnson | |
| 3,575,259 | A | 4/1971 | Wilkinson | |
| 3,583,417 | A | 6/1971 | Clark | |
| 3,611,724 | A * | 10/1971 | Kutney | 60/226.1 |
| 3,618,699 | A | 11/1971 | Evans et al. | |
| 3,623,328 | A | 11/1971 | Pike | |
| 3,623,494 | A | 11/1971 | Poucher | |
| 3,652,036 | A | 3/1972 | Sans et al. | |
| 3,662,556 | A | 5/1972 | Poucher et al. | |
| 3,664,612 | A | 5/1972 | Skidmore et al. | |
| 3,699,682 | A | 10/1972 | Kleckner | |

(Continued)

FOREIGN PATENT DOCUMENTS

| | | |
|---|---|---|
| GB | 1070458 | 6/1965 |
| GB | 1312619 | 4/1973 |

(Continued)

OTHER PUBLICATIONS

Extended European Search Report for Application No. 08252429.9 mailed Nov. 26, 2008.

(Continued)

*Primary Examiner* — Ehud Gartenberg
*Assistant Examiner* — Lorne Meade
(74) *Attorney, Agent, or Firm* — Carlson, Gaskey & Olds PC

(57) ABSTRACT

A nacelle assembly includes an inlet section having a plurality of discrete sections. Each of the plurality of discrete sections includes an adaptive structure. A thickness of each of the plurality of discrete sections is selectively adjustable between a first position and a second position to influence the adaptive structure of each of the plurality of discrete sections.

10 Claims, 3 Drawing Sheets

U.S. PATENT DOCUMENTS 3,716,209 A * 2/1973 Pierce ..... 244/123.1
3,736,750 A 6/1973 Britt
3,763,874 A 10/1973 Wilde et al.
3,770,228 A 11/1973 Traksel et al.
3,905,566 A 9/1975 Anderson
4,007,891 A 2/1977 Sorensen et al.
4,012,013 A 3/1977 Ball et al.
4,044,973 A 8/1977 Moorehead
4,083,181 A 4/1978 Adamson
4,132,240 A 1/1979 Frantz
4,147,029 A 4/1979 Sargisson
4,154,256 A 5/1979 Miller
4,199,295 A 4/1980 Raffy et al.
4,220,171 A 9/1980 Ruehr et al.
4,351,502 A * 9/1982 Statkus ..... 244/219
4,475,702 A * 10/1984 Cole ..... 244/214
4,540,143 A 9/1985 Wang et al.
4,722,357 A 2/1988 Wynosky
4,738,416 A 4/1988 Birbragher
4,827,712 A * 5/1989 Coplin ..... 60/226.1
4,865,268 A 9/1989 Tracksdorf
4,899,958 A 2/1990 Horikawa
4,912,921 A 4/1990 Rice et al.
4,993,663 A 2/1991 Lahti et al.
5,000,399 A 3/1991 Readnour et al.
5,012,639 A 5/1991 Ream et al.
5,014,933 A 5/1991 Harm et al.
5,058,617 A 10/1991 Stockman et al.
5,127,222 A 7/1992 Ream et al.
5,141,182 A 8/1992 Coffinberry
5,143,329 A 9/1992 Coffinberry
5,145,126 A 9/1992 Patilla
5,156,362 A 10/1992 Leon
5,177,957 A 1/1993 Grieb
5,261,227 A 11/1993 Giffin, III
5,284,012 A 2/1994 Laborie et al.
5,297,765 A 3/1994 Hughes et al.
5,351,476 A 10/1994 Laborie et al.
5,357,742 A 10/1994 Miller
5,361,828 A 11/1994 Lee et al.
5,447,283 A 9/1995 Tindell
5,568,724 A 10/1996 Lindner et al.
5,586,431 A 12/1996 Thonebe et al.
5,593,112 A 1/1997 Maier et al.
5,626,017 A 5/1997 Sattelmayer
5,725,182 A 3/1998 Valleroy
5,727,380 A 3/1998 Lardy et al.
5,732,547 A 3/1998 Olsen et al.
5,743,488 A 4/1998 Rolston et al.
5,803,410 A 9/1998 Hwang
5,813,625 A 9/1998 Hassan et al.
5,841,079 A 11/1998 Parente
5,934,611 A 8/1999 Tindell et al.
5,971,328 A * 10/1999 Kota ..... 244/219
5,987,880 A 11/1999 Culbertson
6,055,805 A 5/2000 El-Aini et al.
6,089,505 A 7/2000 Gruensfelder et al.
6,109,566 A 8/2000 Miller et al.
6,129,309 A 10/2000 Smith et al.
6,129,311 A 10/2000 Welch et al.
6,170,253 B1 1/2001 Newton
6,179,251 B1 1/2001 Tindell et al.
6,231,006 B1 * 5/2001 Gruensfelder et al. ..... 244/53 B
6,259,976 B1 * 7/2001 Lemelson et al. ..... 60/226.2
6,260,567 B1 7/2001 Gruensfelder et al.
6,334,753 B1 1/2002 Tillman et al.
6,340,135 B1 1/2002 Barton
6,360,989 B1 3/2002 Maguire
6,375,118 B1 4/2002 Kibens et al.
6,379,110 B1 4/2002 McCormick et al.
6,390,418 B1 5/2002 McCormick et al.
6,471,477 B2 10/2002 Hassan et al.
6,651,929 B2 11/2003 Dionne
6,655,632 B1 12/2003 Gupta et al.
6,698,691 B2 3/2004 Porte
6,708,711 B2 3/2004 Surply et al.
6,763,651 B2 7/2004 Shmilovich et al.
6,764,043 B2 7/2004 Sankrithi et al.
6,793,177 B2 9/2004 Bonutti
6,971,229 B2 12/2005 Lair
7,048,229 B2 5/2006 Sanders et al.
7,048,230 B2 5/2006 Meyer
7,090,165 B2 8/2006 Jones et al.
7,131,612 B2 11/2006 Baptist et al.
7,165,744 B2 1/2007 Howarth et al.
7,255,309 B2 8/2007 Boldrin et al.
7,384,016 B2 * 6/2008 Kota et al. ..... 244/123.1
7,617,670 B2 11/2009 Truax et al.
7,735,601 B1 6/2010 Stieger et al.
7,739,865 B2 6/2010 Prasad et al.
7,766,280 B2 8/2010 Cloft et al.
7,802,760 B2 9/2010 Webster
7,870,721 B2 1/2011 Winter et al.
2004/0037162 A1 2/2004 Flohr et al.
2004/0237534 A1 12/2004 Webster et al.
2005/0060982 A1 3/2005 Mani et al.
2005/0274103 A1 12/2005 Prasad et al.
2006/0155432 A1 7/2006 Brown
2007/0221788 A1 9/2007 Meister
2008/0092548 A1 4/2008 Morford et al.
2008/0112799 A1 5/2008 Winter et al.
2008/0267762 A1 10/2008 Jain et al.
2008/0283676 A1 11/2008 Jain et al.
2008/0286094 A1 11/2008 Jain
2009/0003997 A1 1/2009 Jain et al.
2009/0008508 A1 1/2009 Jain et al.
2009/0121083 A1 5/2009 Jain

FOREIGN PATENT DOCUMENTS

GB 1336724 11/1973
GB 1382809 2/1975

OTHER PUBLICATIONS

U.S. Appl. No. 11/584,030, filed Oct. 20, 2006, Morford, et al.
U.S. Appl. No. 11/595,040, filed Nov. 10, 2006, Winter, et al.
U.S. Appl. No. 11/749,260, filed May 16, 2007, Jain, et al.
U.S. Appl. No. 11/750,398, filed May 18, 2007, Jain, et al.
U.S. Appl. No. 11/772,287, filed Jul. 2, 2007, Jain, et al.
U.S. Appl. No. 11/739,216, filed Apr. 24, 2007, Jain, et al.
Extended European Search Report for Application No. EP 08 25 3874 dated Jan. 25, 2012.
Extended European Search Report for Application No. EP 08 25 1047 dated Sep. 6, 2011.
Extended European Search Report for Application No. EP 08 25 2263 dated Aug. 19, 2011.
Extended European Search Report for Application No. EP 08 25 2429 dated Nov. 26, 2008.
Extended European Search Report for Application No. EP 07 25 4305 dated Aug. 19, 2011.

* cited by examiner

VARIABLE SHAPE INLET SECTION FOR A NACELLE ASSEMBLY OF A GAS TURBINE ENGINE

BACKGROUND OF THE INVENTION

This invention generally relates to a gas turbine engine, and more particularly to a gas turbine engine having a variable shape inlet section.

In an aircraft gas turbine engine, such as a turbofan engine, air is pressurized in a compressor and mixed with fuel in a combustor for generating hot combustion gases. The hot combustion gases flow downstream through turbine stages which extract energy from the hot combustion gases. A fan section supplies air to the compressor.

Combustion gases are discharged from the turbofan engine through a core exhaust nozzle and a quantity of fan air is discharged through an annular fan exhaust nozzle defined at least partially by a nacelle assembly surrounding the core engine. A majority of propulsion thrust is provided by the pressurized fan air which is discharged through the fan exhaust nozzle, while the remaining thrust is provided by the combustion gases discharged through the core exhaust nozzle.

It is known in the field of aircraft gas turbine engines that the performance of a turbofan engine varies during diversified operability conditions experienced by the aircraft. An inlet lip section located at the foremost end of the turbofan nacelle assembly is typically designed to enable operation of the turbofan engine and reduce separation of airflow from the internal and external flow surfaces of the inlet lip section during these diversified conditions. For example, the nacelle assembly requires a "thick" inlet lip section to support operation of the engine during specific flight conditions, such as crosswind conditions, take-off conditions and the like. Disadvantageously, the "thick" inlet lip section may reduce the efficiency of the turbofan engine during normal cruise conditions of the aircraft, for example. As a result, the maximum diameter of the nacelle assembly is approximately 10-20% larger than required during cruise conditions. Since aircraft typically operate in cruise conditions for extended periods, turbofan efficiency gains can lead to substantially reduced fuel burn and emissions.

Accordingly, it is desirable to provide a nacelle assembly having an adaptive structure to improve the performance of a turbofan gas turbine engine during diversified operability conditions.

SUMMARY OF THE INVENTION

A nacelle assembly includes an inlet section having a plurality of discrete sections. Each of the plurality of discrete sections includes an adaptive structure. A thickness of each of the plurality of discrete sections is selectively adjustable between a first position and a second position to influence the adaptive structure of each of the plurality of discrete sections.

A gas turbine engine includes a compressor section, a combustor section, a turbine section, and a nacelle assembly which at least partially surrounds at least one of the compressor section, the combustor section and the turbine section. The nacelle assembly includes a plurality of discrete sections each having an adaptive structure. A leading edge and a thickness of each of the plurality of discrete sections are selectively adjustable to influence the adaptive structure of each of the plurality of discrete sections. A controller identifies an operability condition and selectively commands adjustment of each of the leading edge and the thickness of each of the plurality of discrete sections in response to sensing the operability condition.

The various features and advantages of this invention will become apparent to those skilled in the art from the following detailed description. The drawings that accompany the detailed description can be briefly described as follows.

DETAILED DESCRIPTION OF THE PREFERRED EMBODIMENT

Figure 1:
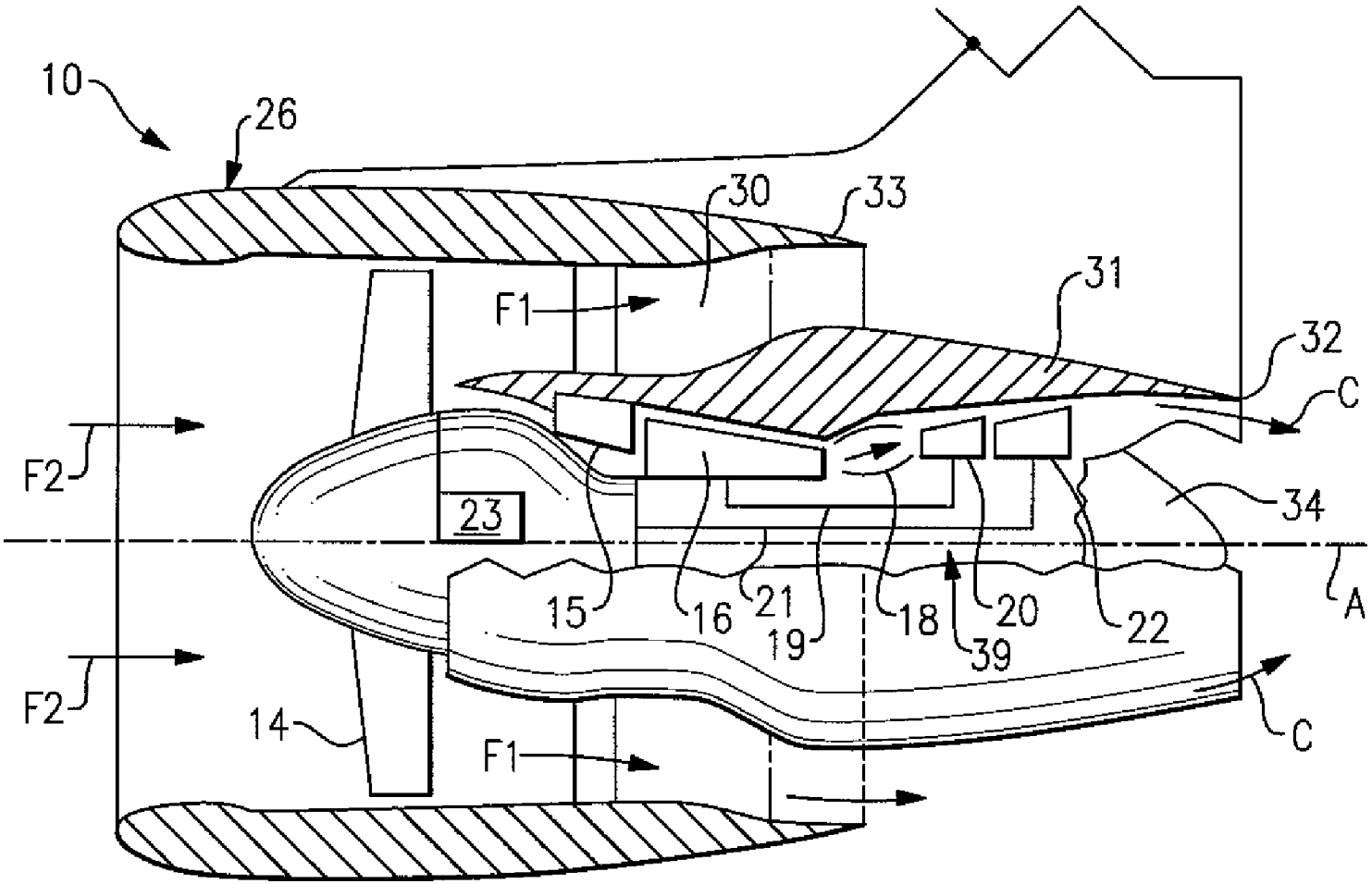
FIG. 1 illustrates a general sectional view of a gas turbine engine.

FIG. 1 illustrates a gas turbine engine 10 which includes (in serial flow communication) a fan section 14, a low pressure compressor 15, a high pressure compressor 16, a combustor 18, a high pressure turbine 20 and a low pressure turbine 22. During operation, air is pulled into the gas turbine engine 10 by the fan section 14, pressurized by the compressors 15, 16 and is mixed with fuel and burned in a combustor 18. Hot combustion gases generated within the combustor 18 flow through the high and low pressure turbines 20, 22 which extract energy from the hot combustion gases.

In a two-spool gas turbine engine architecture, the high pressure turbine 20 utilizes the energy extracted from the hot combustion gases to power the high pressure compressor 16 through a high speed shaft 19, and the low pressure turbine 22 utilizes the energy extracted from the hot combustion gases to power the low pressure compressor 15 and the fan section 14 though a low speed shaft 21. However, the invention is not limited to the two-spool gas turbine engine architecture described and may be used with other architectures, such as a single-spool axial design, a three-spool axial design and other architectures. That is, the present invention is applicable to any gas turbine engine, and to any application.

The example gas turbine engine 10 is in the form of a high bypass ratio turbofan engine mounted within a nacelle assembly 26, in which a significant amount of air pressurized by the fan section 14 bypasses the core engine 39 for the generation of propulsion thrust. The nacelle assembly 26 partially surrounds an engine casing 31 that houses the core engine 39 and its components. The airflow entering the fan section 14 may bypass the core engine 39 via a fan bypass passage 30 which extends between the nacelle assembly 26 and the engine casing 31 for receiving and communicating a discharge airflow F1. The high bypass flow arrangement provides a significant amount of thrust for powering the aircraft.

The engine 10 may include a geartrain 23 that controls the speed of the rotating fan section 14. The geartrain 23 can be any known gear system, such as a planetary gear system with orbiting planet gears, a planetary gear system with non-orbiting planet gears or other type of gear system. In the disclosed example, the geartrain 23 has a constant gear ratio. It should be understood, however, that the above parameters are only examples of a contemplated geared turbofan engine 10. That is, the invention is applicable to traditional turbofan engines as well as other engine architectures.

The discharge airflow F1 is discharged from the engine 10 through a fan exhaust nozzle 33. Core exhaust gases C are discharged from the core engine 39 through a core exhaust nozzle 32 disposed between the engine casing 31 and a center plug 34 disposed coaxially around a longitudinal centerline axis A of the gas turbine engine 10.

Figure 2:
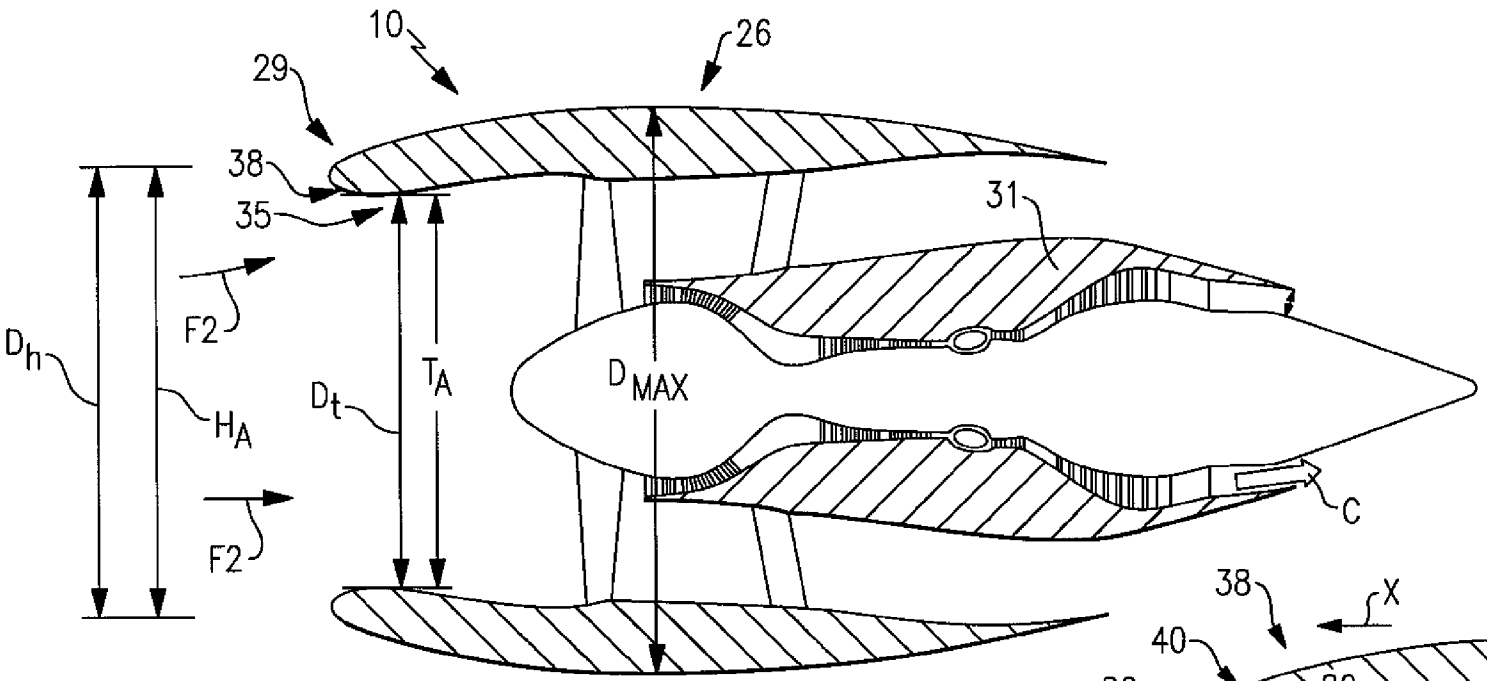
FIG. 2 illustrates a nacelle assembly of a gas turbine engine illustrated in FIG. 1.

FIG. 2 illustrates an example inlet lip section 38 of the nacelle assembly 26. The inlet lip section 38 is positioned near a forward segment 29 of the nacelle assembly 26. A boundary layer 35 is associated with inlet lip section 38. The boundary layer 35 represents an area adjacent to each of an inner and outer flow surface of the inlet lip section 38 at which the velocity gradient of airflow is zero. That is, the velocity profile of oncoming airflow F2 goes from a free stream away from the boundary layer 35 to near zero at the boundary layer 35 due to friction forces that occur as the oncoming airflow F2 passes over the outer and inner flow surfaces of the inlet lip section 38.

The inlet lip section 38 defines a contraction ratio. The contraction ratio represents a relative thickness of the inlet lip section 38 of the nacelle assembly 26 and is represented by the ratio of a highlight area $H_a$ (ring shaped area defined by highlight diameter $D_h$) and a throat area $T_a$ (ring shaped area defined by throat diameter $D_t$). Currently industry standards typically require a contraction ratio of approximately 1.33 to reduce the separation of oncoming airflow F2 from the outer and inner flow surfaces of the inlet lip section 38 during engine operation, but other contraction ratios may be feasible. "Thick" inlet lip section designs, which are associated with large contraction ratios, increase the maximum diameter $D_{max}$ and increase the weight and drag penalties associated with the nacelle assembly 26. In addition, a desired ratio of the maximum diameter Dmax relative to the highlight diameter $D_h$ is typically less than or equal to about 1.5, for example. A person of ordinary skill in the art would understand that other ratios of the maximum diameter Dmax relative to the highlight diameter $D_h$ are possible and will vary depending upon design specific parameters.

Figure 3:
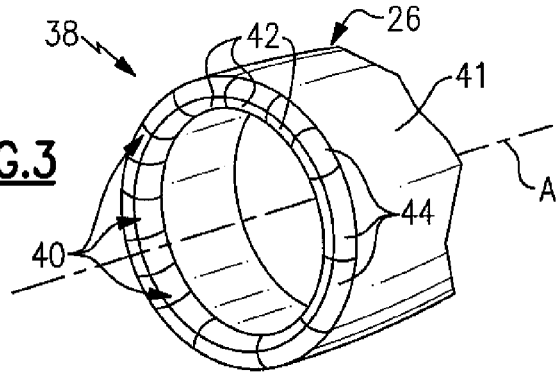
FIG. 3 illustrates a general perspective view of the nacelle assembly of a gas turbine engine shown in FIG. 1.

Referring to FIG. 3, the inlet lip section 38 includes a plurality of discrete sections 40 disposed circumferentially about the engine longitudinal centerline axis A. Each of the discrete sections 40 includes a leading edge 42 and a body panel portion 44. Each discrete section 40 has an adaptive structure that is capable of a shape change. The inlet lip section 38 is sectioned into the plurality of discrete sections 40 to reduce the stiffness of the closed annular structure of the inlet lip section 38 and allow flexure thereof. Each discrete section 40 is designed to be capable of deformation (i.e., the materials remain within their elastic limits), yet simultaneously have the requisite stiffness to maintain a deformed shape while under aerodynamic and external pressure loads. In addition, as would be understood by those of ordinary skill in the art having the benefit of this disclosure, each discrete section 40 could slightly overlap with adjacent discrete sections 40 to allow the shape change of the inlet lip section 38 to occur without interference. A fixed nacelle portion 41 is positioned downstream from the inlet lip section 38.

In one example, the discrete sections 40 are comprised of an aluminum alloy. In another example, the discrete sections are comprised of a titanium alloy. It should be understood that any deformable material may be utilized to form the discrete sections 40. A person of ordinary skill in the art having the benefit of this description would be able to choose an appropriate material for the example discrete sections 40 of the inlet lip section 38.

Influencing the adaptive structure of the inlet lip section 38 during specific flight conditions to achieve a desired shape change increases the amount of airflow communicated through the gas turbine engine 10 and reduces the internal and external drag experienced by the inlet lip section 38. In one example, the adaptive structure of the inlet lip section 38 is influenced by adjusting the shape of the leading edge 42 of each discrete section 40 (see FIGS. 4A and 4B). In another example, the adaptive structure of the inlet lip section 38 is influenced by adjusting a thickness of the body panel portions 44 of each discrete section 40 (see FIG. 5). In yet another example, the adaptive structure of the inlet lip section 38 is influenced by adjusting both the leading edge 42 and the thickness of the body panel portion 44 of each discrete section 40.

Figure 4A:
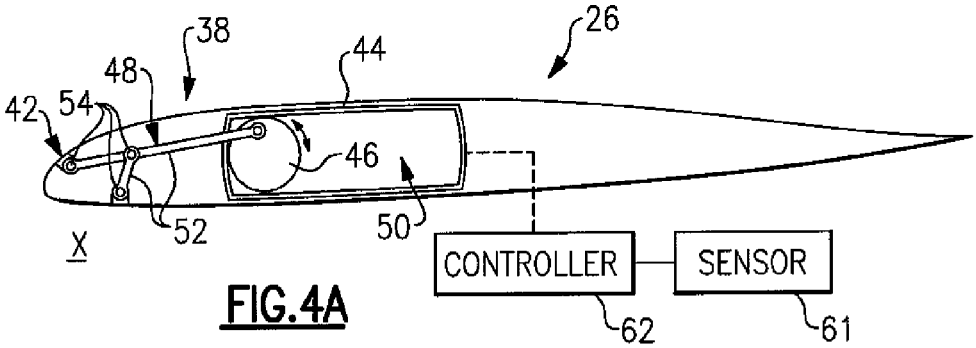
FIG. 4A illustrates a first example position of a leading edge of an inlet section of the nacelle assembly.
Figure 4B:
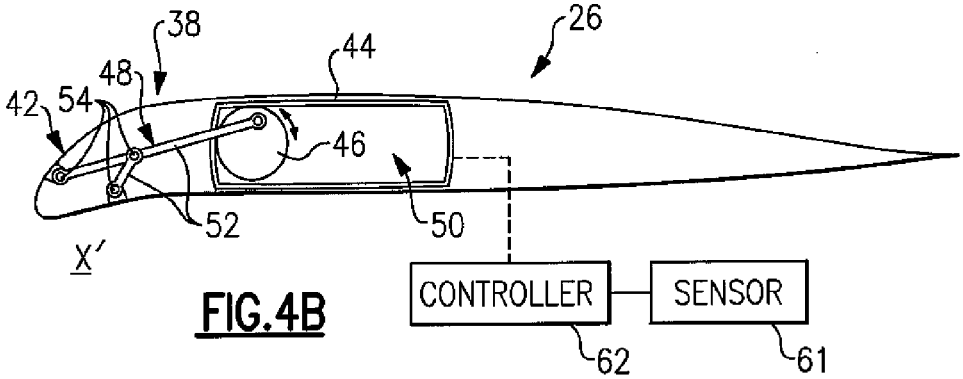
FIG. 4B illustrates a second example position of the leading edge of the inlet section of the nacelle assembly.

FIGS. 4A and 4B illustrate the adjustment of the leading edge 42 of a discrete section 40 of the inlet lip section 38 between a first position X (see FIG. 4A) and a second position X' (see FIG. 4B). The first position X represents a "thin" inlet lip section 38. The second position X' represents a "blunt" inlet lip section 38. Each leading edge 42 is moved between the first position X and the second position X' via a rotary actuator 46, for example. The rotary actuator 46 rotates in either a clockwise or counterclockwise direction to move a linkage assembly 48 and adjust the leading edge 42 between the first position X and the second position X'. The rotary actuator 46 and the linkage assembly 48 are mounted within a cavity 50 of each discrete section 40.

At least one linkage assembly 48 is provided within each discrete section 40 and includes a plurality of linkage arms 52 and a plurality of pivot points 54. The rotary actuator 46 pivots, toggles, extends and/or flexes the linkage arms 52 of the linkage assembly 48 about the pivot points 54 to move the leading edge 42 between the "thin", first position X and the "blunt", second position X'. Although the present example is illustrated with a rotary actuator and linkage arms connected via pivot points, other mechanisms may be utilized to move the leading edges 42 of the discrete sections 40 between the first position X and the second position X', including but not limited to linear actuators, bell cranks, etc. A person of ordinary skill in the art having the benefit of this disclosure will be able to implement an appropriate actuator assembly to manipulate the leading edge 42 of each discrete section 40. In addition, it should be understood that the leading edge 42 is moveable to any position between the first position X and second position X'.

The adaptive structure of the inlet lip section 38 is influenced by moving the leading edge 42 of each discrete section 40 between the first position X and the second position X' in response to detecting an operability condition of the gas turbine engine 10. In one example, the operability condition includes a take-off condition. In another example, the operability condition includes a climb condition. In yet another example, the operability condition includes a landing condition. In still another example, the operability condition includes a high angle of attack condition. It should be understood that the adaptive structure of the inlet lip section 38 is adjustable in response to any operability condition experienced by the aircraft. Each leading edge 42 is positioned at/returned to the first position X during normal cruise conditions of the aircraft.

A sensor 61 detects the operability condition and communicates with a controller 62 to translate the leading edge 42 between the first position X and the second position X' and influence the adaptive structure of the inlet lip section 38. Of course, this view is highly schematic. In addition, the illustrations of the movement of the inlet lip section 38 are shown exaggerated to better illustrate the adaptive structure thereof. A person of ordinary skill in the art would understand the distances the leading edge 42 should be moved between the position X and the second position X' in response to sensing a specific operability condition.

It should be understood that the sensor 61 and the controller 62 may be programmed to detect any known operability condition and that each operability condition may be associated with a distinct position of the leading edge 42 of the inlet lip section 38. That is, the sensor 61 and the controller 62 are operable to situate the leading edge 42 of each discrete section 40 at a position which corresponds to the operability condition that is detected. Also, the sensor can be replaced by any controller associated with the gas turbine engine 10 or an associated aircraft. In fact, the controller 62 itself can include the "sensor" and generate the signal to adjust the contour of the inlet lip section 38.

Figure 5:
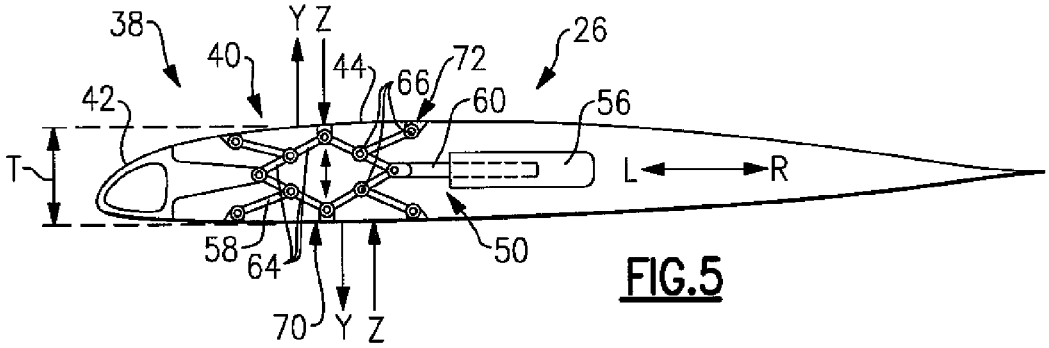
FIG. 5 illustrates an example mechanism for manipulating an adaptive structure of an inlet section of a nacelle assembly.

FIG. 5 illustrates the adjustment of a thickness T of a body panel portion 44 of each discrete section 40 to influence the adaptive structure of the inlet lip section 38. The thickness T of the body panel 44 is adjustable between a "thin" inlet lip section 38 and a "thick" inlet lip section 38, for example. An inner surface 70 and an outer surface 72 of each body panel portion 44 are moveable in a Y direction (i.e., radially outward) to adjust each discrete section 40 to a "thick" position. In addition, the inner and outer surfaces 70, 72 are moveable in a Z direction to adjust each discrete section to a "thin" position.

The thickness T adjustment of each body panel portion 44 is achieved via a linear actuator 56 and a linkage assembly 58. The linear actuator 56 and the linkage assembly 58 are received in the cavity 50 of each discrete section 40. Although the present example is illustrated with a linear actuator and linkage arms connected via pivot points, other mechanisms may be utilized to adjust the thickness T of each body panel portion 44.

The linear actuator 56 includes an actuator arm 60 which is moveable in a R or L direction to move the linkage assembly 58 and thereby adjust the thickness of the body panel portion 44. The linkage assembly 58 includes a plurality of linkages 64 and a plurality of pivot points 66. The linear actuator 56 adjusts the thickness T of each body panel portion 44 by retracting, pivoting, toggling, extending and/or flexing the linkages 64 about each pivot point 66. In one example, the actuator arm 60 of the linear actuator 56 moves in a R direction to retract the outer skin (i.e., move the outer skin in the Z direction) of the body panel portion 44 and provide a "thin" inlet lip section 38. In another example, the actuator arm 60 of the linear actuator 56 is moved in a L direction to expand the outer skin (i.e., move the outer skin in the Y direction) of the body panel portion 44 and provide a "thick" inlet lip section 38. That is, the thickness T of each body panel portion 44 is adjusted either radially outwardly or radially inwardly to provide a "thick" inlet lip section or a "thin" inlet lip section, respectively.

The thickness of each discrete section 40 is adjusted in response to detecting an operability condition. In one example, the operability condition includes a take-off condition. In another example, the operating condition includes a climb condition. In another example, the operability condition includes a high angle of attack condition. In still another example, the operability condition includes a landing condition. It should be understood that the thickness of the body panel portion 44 may be adjusted to influence the adaptive structure of the inlet lip section 38 in response to any operability condition experienced by the aircraft. The thickness T is adjusted/returned to a "thin" position at cruise conditions of the aircraft.

A sensor 61, as is shown in FIGS. 4*a* and 4*b*, detects the operability condition and communicates with a controller 62 to adjust the thickness T of each discrete section 40. Of course, this view is highly schematic. In addition, the illustrations of the movement of the inlet lip section 38 are shown exaggerated to better illustrate the adaptive structure thereof. A person of ordinary skill in the art would understand the distances the thickness T should be adjusted in response to sensing a specific operability condition.

It should be understood that the sensor 61 and the controller 62 may be programmed to detect any known operability condition and that each operability condition may be associated with a distinct thickness T of the body panel portions 44 of the discrete sections 40. That is, the sensor 61 and the controller 62 are operable to adjust the thickness T of each discrete section 40 to a position which corresponds to the operability condition that is detected. The thickness T of each discrete section 40 may be adjusted uniformly or differently about the circumference. In some instances, such as operating during strong cross-winds, for example, only certain discrete sections 40 may be adjusted, while other discrete sections 40 are left unchanged. Also, the sensor can be replaced by any controller associated with the gas turbine engine 10 or an associated aircraft. In fact, the controller 62 itself can generate the signal to adjust the contour of the inlet lip section 38.

Although illustrated in FIGS. 4 and 5 as having only a single mechanism for adjusting the shape of the inlet lip section 38 (i.e., one of a rotary actuator 46 with a linkage assembly 48 or a linear actuator 56 with a linkage assembly 58), it should be understood that each discrete section 40 could include both types of mechanisms to achieve both a leading edge adjustment and a thickness adjustment of the inlet lip section 38. A person of ordinary skill in the art having the benefit of this disclosure would be able to design the inlet lip section 38 to achieve a desired aerodynamic performance level.

Figure 6:
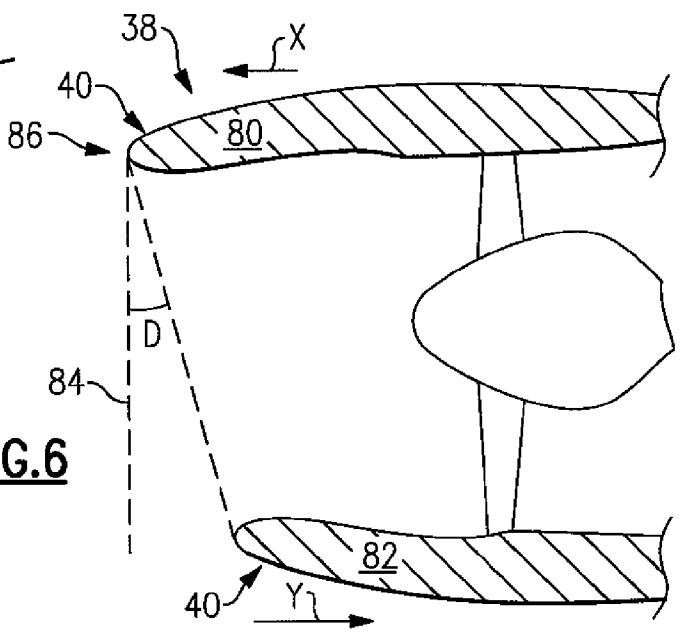
FIG. 6 illustrates a side view of the inlet section of the nacelle assembly of a gas turbine engine.

Influencing the adaptive structure of the inlet lip section 38 may also be achieved during diverse operating conditions by "drooping" a portion of the inlet lip section 38 relative to a remaining portion of the inlet lip section 38 (See FIG. 6). In one example, a portion of the discrete sections 40 positioned near a top portion 80 of the inlet lip section 38 are translated in an X direction and a portion of discrete sections 40 positioned near a bottom portion 82 of the inlet lip section 38 are translated in a Y direction to create a droop angle D relative to a plane 84 defined by the foremost end 86 of the inlet lip section 38. The translations of the discrete sections 40 in the X and Y directions are achieved via adjustment of linkage assembly 48 (See FIGS. 4*a* and 4*b*), the linkage assembly 58 (See FIG. 5) or a combination of both the linkage assembly 48 and the linkage assembly 58. The droop angle D is between 2 to 6 degrees relative to the plane 84, in one example. Although FIG. 6 illustrates the "droop" of the bottom portion 82 relative to the remaining portion of the inlet lip section 38, it should be understood that any portion of the inlet lip section 38 may be drooped to improve the aircraft engine performance and reduce nacelle drag at all flight conditions.

The adaptive inlet lip section 38 improves aerodynamic performance of the gas turbine engine 10 during all operability conditions experienced by the aircraft. In addition, because of the shape changing capabilities of the inlet lip section 38, the aircraft may be designed having a "thin" inlet lip section 38 (i.e., a slim line nacelle having a reduced contraction ratio is achieved). As a result, the nacelle assembly 26 is designed for specific cruise conditions of the aircraft. A reduced maximum diameter of the nacelle assembly 26 may therefore be achieved while reducing weight, reducing drag, reducing fuel burn and increasing the overall efficiency of the gas turbine engine 10.

The foregoing description shall be interpreted as illustrative and not in any limiting sense. A worker of ordinary skill in the art would recognize that certain modifications would come within the scope of this invention. For that reason, the following claims should be studied to determine the true scope and content of this invention.

What is claimed is:

1. A gas turbine engine, comprising:

a compressor section, a combustor section and a turbine section;

a nacelle assembly at least partially surrounding at least one of said compressor section, said combustor section and said turbine section, wherein said nacelle assembly includes a plurality of discrete sections circumferentially disposed about an engine longitudinal centerline axis and each having a leading edge and a body panel portion including a first portion and a second portion; said first portion facing radially inward and being aft of said leading edge and said second portion facing radially outward and being aft said leading edge; said first portion and said second portion having a common adaptive structure and defining a nacelle thickness; wherein said thickness is selectively adjustable by a simultaneous deployment of said first and said second portions by said adaptive structure of said body panel portion relative to said engine longitudinal centerline axis to alter said adaptive structure; and a programmable controller that identifies an operability condition, wherein said programmable controller selectively commands the adjustment of said nacelle thickness of said plurality of discrete sections in response to said operability condition.

2. The gas turbine engine as recited in claim 1, comprising a sensor that produces a signal representing said operability condition and communicates said signal to said programmable controller.

3. The gas turbine engine as recited in claim 1, comprising an actuator and at least one linkage mounted within a cavity of each of said plurality of discrete sections, wherein said at least one linkage is moveable by said actuator to adjust said thickness.

4. The gas turbine engine as recited in claim 1, wherein said plurality of discrete sections are disposed about an entire circumference of said nacelle assembly.

5. The gas turbine engine as recited in claim 1, wherein said thickness of each of said plurality of discrete sections is adjusted non-uniformly.

6. The gas turbine engine as recited in claim 1, comprising a fan section and a geartrain that controls a speed of said fan section.

7. The gas turbine engine as recited in claim 1, wherein each of said plurality of discrete sections are formed of a deformable metallic material.

8. The gas turbine engine as recited in claim 1, comprising a linear actuator and a linkage assembly mounted within a cavity of each of said plurality of discrete sections.

9. The gas turbine engine as recited in claim 8, wherein said linkage assembly includes a plurality of linkages and a plurality of pivot points, and said linear actuator alters said thickness by adjusting said linkages about each of said plurality of pivot points.

10. A gas turbine engine, comprising:

a nacelle assembly including an inlet lip section circumferentially disposed about an engine longitudinal centerline axis and having a plurality of discrete sections each having a leading edge and a body panel portion including a first portion and a second portion; said first portion facing radially inward and being aft of said leading edge and said second portion facing radially outward and being aft said leading edge; said first portion and said second portion having a common adaptive structure and defining a nacelle thickness; wherein said thickness is selectively adjustable by a simultaneous deployment of said first and said second portions by said adaptive structure of said body panel portion relative to said engine longitudinal centerline axis to alter said adaptive structure of each of said plurality of discrete sections; and wherein the adaptive structure of a first discrete section of said plurality of discrete sections is altered independently of the adaptive structure of a second discrete section of said plurality of discrete sections.

* * * * *